US010964335B2

(12) United States Patent
Kim et al.

(10) Patent No.: US 10,964,335 B2
(45) Date of Patent: Mar. 30, 2021

(54) MULTIPLE MICROPHONE SPEECH GENERATIVE NETWORKS

(71) Applicant: QUALCOMM Incorporated, San Diego, CA (US)

(72) Inventors: Lae-Hoon Kim, San Diego, CA (US); Shuhua Zhang, San Diego, CA (US); Erik Visser, San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 234 days.

(21) Appl. No.: 15/948,681

(22) Filed: Apr. 9, 2018

(65) Prior Publication Data

US 2019/0311728 A1 Oct. 10, 2019

(51) Int. Cl.

| | |
|---|---|
| ***H04R 3/00*** | (2006.01) |
| ***G10L 21/0364*** | (2013.01) |
| ***H04R 1/40*** | (2006.01) |
| ***G10L 25/84*** | (2013.01) |

(52) U.S. Cl.

CPC ..... *G10L 21/0364* (2013.01); *G10L 25/84* (2013.01); *H04R 1/406* (2013.01); *H04R 3/005* (2013.01)

(58) Field of Classification Search

CPC ..... H04R 1/406; H04R 5/027; G10L 2021/02166

USPC ..... 381/92, 122

See application file for complete search history.

(56) References Cited

U.S. PATENT DOCUMENTS

2004/0252845 A1* 12/2004 Tashev ..... G01S 3/8034 381/56

2008/0031464 A1* 2/2008 Nielsen ..... G10L 25/48 381/56

2009/0150149 A1* 6/2009 Culter ..... G06K 9/6293 704/246

* cited by examiner

*Primary Examiner* — George C Monikang

(74) *Attorney, Agent, or Firm* — Espartaco Diaz Hidalgo

(57) ABSTRACT

Methods, systems, and devices for auditory enhancement are described. A device may receive a respective auditory signal at each of a set of microphones, where each auditory signal includes a respective representation of a target auditory component and one or more noise artifacts. The device may identify a directionality associated with a source of the target auditory component (e.g., based on an arrangement of the multiple microphones). The device may determine a distribution function for the target auditory component based at least in part on the directionality associated with the source and on the received plurality of auditory signals. The device may generate an estimate of the target auditory component based at least in part on the distribution function and output the estimate of the target auditory component.

22 Claims, 10 Drawing Sheets

100

100

200

800

MULTIPLE MICROPHONE SPEECH GENERATIVE NETWORKS

BACKGROUND

The following relates generally to auditory enhancement, and more specifically to multiple microphone speech generative networks.

Signals communicated over a wireless medium (e.g., speech, wireless communications, etc.) may experience interference (e.g., from other such signals, from physical obstacles in the communication environment, etc.). By way of example, a user may be located in a communication environment that includes multiple auditory sources, each producing a respective auditory signal. The communication environment may thus be noisy, and it may be difficult for the user to distinguish a target auditory signal from one of the multiple auditory sources. Improved techniques for resolving a target signal in a noisy communication environment may be desired.

SUMMARY

The described techniques relate to improved methods, systems, devices, and apparatuses that support multiple microphone speech generative networks. Generally, a device may include multiple microphones for receiving auditory input signals (e.g., where the respective auditory input signal at each microphone comprises a target auditory component as well as various noise artifacts). In accordance with the described techniques, the multiple microphones may be arranged in the device so as to support directional reception. The device may leverage the directionality associated with the microphones in conjunction with auditory parameters of the target auditory component to generate a clean auditory signal (e.g., to remove or reduce the contributions of the various noise artifacts). For example, the device may be trained to extract a specific type of signal (e.g., speech) that originates in a given region of a communication environment (e.g., where the given region may be based at least in part on the microphone arrangement). For example, the device may sample the auditory input signals received at the multiple microphones (e.g., in time and/or frequency) and may then apply a loss function to the samples (e.g., such that a distribution function of the samples is mapped to a target distribution function associated with the target auditory component). The device may generate an estimate of the target auditory component based at least in part on the loss function and may output the estimate (e.g., to a user of the device).

A method of auditory enhancement at a device is described. The method may include receiving a respective auditory signal at each of a set of microphones, where each auditory signal includes a respective representation of a target auditory component and one or more noise artifacts, identifying a directionality associated with a source of the target auditory component, determining a distribution function for the target auditory component based on the directionality associated with the source and on the received set of auditory signals, generating an estimate of the target auditory component based on the distribution function, and outputting the estimate of the target auditory component.

An apparatus for auditory enhancement is described. The apparatus may include a processor, memory in electronic communication with the processor, and instructions stored in the memory. The instructions may be executable by the processor to cause the apparatus to receive a respective auditory signal at each of a set of microphones, where each auditory signal includes a respective representation of a target auditory component and one or more noise artifacts, identify a directionality associated with a source of the target auditory component, determine a distribution function for the target auditory component based on the directionality associated with the source and on the received set of auditory signals, generate an estimate of the target auditory component based on the distribution function, and output the estimate of the target auditory component.

Another apparatus for auditory enhancement is described. The apparatus may include means for receiving a respective auditory signal at each of a set of microphones, where each auditory signal includes a respective representation of a target auditory component and one or more noise artifacts, means for identifying a directionality associated with a source of the target auditory component, means for determining a distribution function for the target auditory component based on the directionality associated with the source and on the received set of auditory signals, means for generating an estimate of the target auditory component based on the distribution function, and means for outputting the estimate of the target auditory component.

In some examples of the method and apparatuses described herein, determining the distribution function for the target auditory component may include operations, features, means, or instructions for identifying, for each of the received set of auditory signals, a respective set of samples corresponding to a target time window and generating the distribution function for the target time window based on the set of samples for each of the set of auditory signals.

In some examples of the method and apparatuses described herein, identifying a given set of samples corresponding to the target time window for a given microphone of the set of microphones may include operations, features, means, or instructions for determining, based on the directionality associated with the source of the target auditory component, a time-delay for the given microphone and generating the given set of samples by applying the time-delay to the respective auditory signal received at the given microphone.

In some examples of the method and apparatuses described herein, generating the distribution function for the target time window may include operations, features, means, or instructions for identifying a vector corresponding to a hidden state of a recurrent neural network, the hidden state associated with a second time window different from the target time window and generating the distribution function based on the vector.

In some examples of the method and apparatuses described herein, the hidden state of the recurrent neural network includes a cell of a long short-term memory (LSTM) network.

In some examples of the method and apparatuses described herein, generating the estimate of the target auditory component may include operations, features, means, or instructions for identifying an argument value corresponding to a maximum value of the distribution function, where the estimate of the target auditory component may be based on the argument value.

In some examples of the method and apparatuses described herein, the target auditory component includes a speech signal. In some examples of the method and apparatuses described herein, the estimate of the target auditory component includes a vector in a complex spectrum domain. In some examples of the method and apparatuses described herein, the directionality associated with the source of the target auditory component may be based on a spatial arrangement of the set of microphones.

Some examples of the method and apparatuses described herein may further include operations, features, means, or instructions for identifying a target distribution function based at least part on a type of the target auditory component, generating a distribution adjustment factor by applying a loss function to the estimate of the target auditory component and the target distribution function and determining a second distribution function for a second target auditory component received in a second auditory signal based on the distribution adjustment factor.

DETAILED DESCRIPTION

Over-the-air signals (e.g., speech, music, wireless communications, and the like) may in some cases suffer from interference introduced between a source and a receiver of the signal. The interference may be in the form of physical obstacles, other signals, additive white Gaussian noise (AWGN), or the like. Aspects of the present disclosure relate to techniques for removing the effects of this interference (e.g., to provide for a clean estimate of the original signal). By way of example, the described techniques may provide for using a directionality and/or signal type associated with the source as factors in generating the clean estimate. Though described in the context of speech signals, it is to be understood that the described techniques may apply to other target signal types (e.g., music, engine noise, animal sounds, etc.). For example, each such target signal type may be associated with a given distribution function (e.g., which may be learned by a given device in accordance with aspects of the present disclosure). The learned distribution function may be used in conjunction with a directionality of the source signal (e.g., which may be based at least in part on a physical arrangement of microphones within the device) to generate the clean signal estimate. Thus, the described techniques generally provide for the use of a spatial constraint and/or target distribution function (each of which may be determined based at least in part on a trained recurrent neural network) to generate the clean signal.

Aspects of the disclosure are initially described in the context of a communication diagram. Aspects of the disclosure are then described in the context of process flows. Aspects of the disclosure are further illustrated by and described with reference to apparatus diagrams, system diagrams, and flowcharts that relate to multiple microphone speech generative networks.

Figure 1:
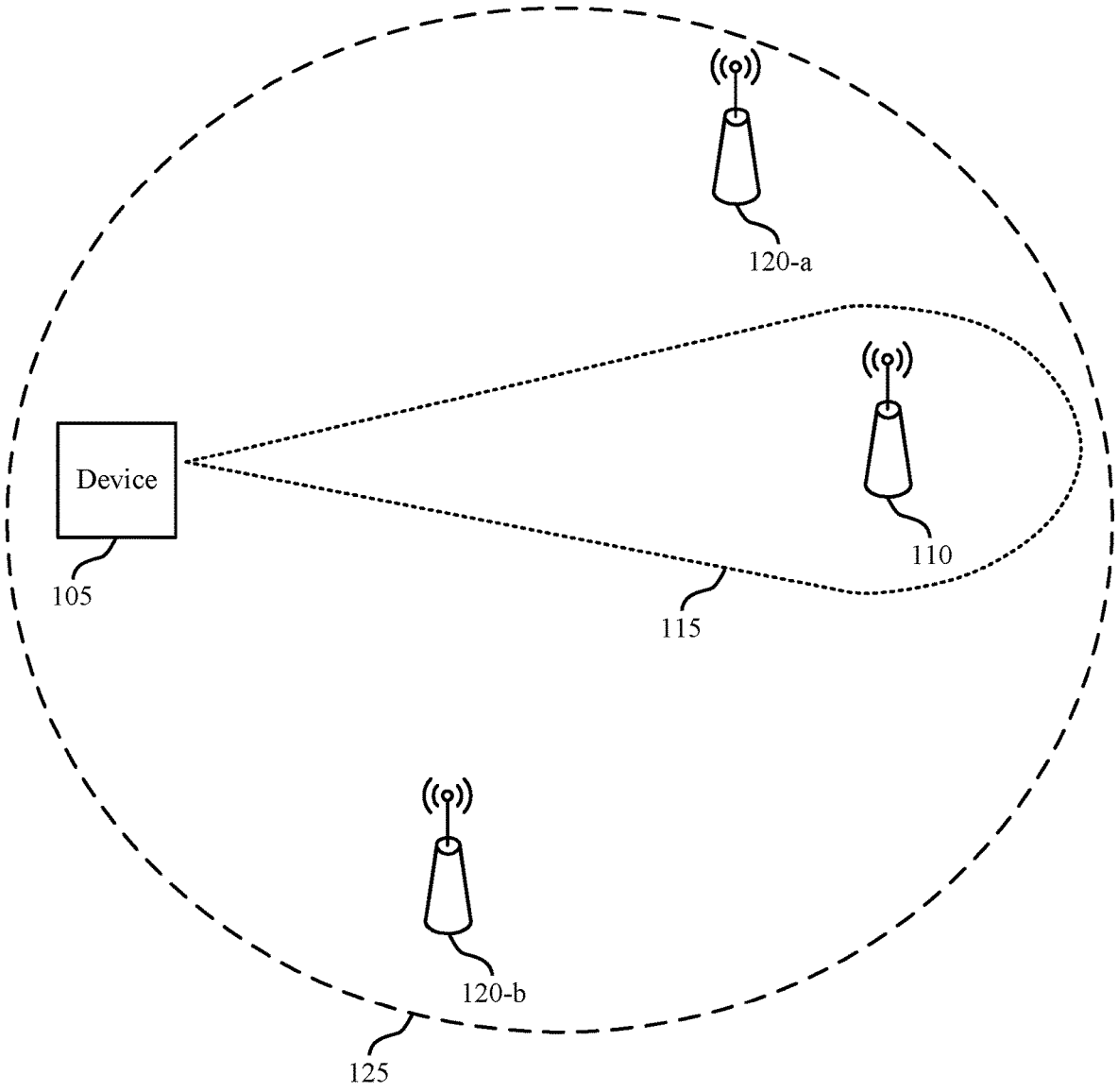
FIG. 1 illustrates an example of a communication diagram that supports multiple microphone speech generative networks in accordance with aspects of the present disclosure.

FIG. 1 illustrates a communication diagram 100 that supports multiple microphone speech generative networks in accordance with aspects of the present disclosure. In some examples, a device 105 may operate within communication environment 125. Communication environment 125 may comprise multiple audio sources and may include various acoustic properties. The volume of communication environment 125 may be or represent the range at which device 105 may receive auditory signals (e.g., above a given threshold). Device 105 may utilize a plurality of microphones (e.g., six microphones) for receiving auditory signals. In some cases, the microphones may represent components of the device. Additionally or alternatively, the microphones may be or represent peripheral devices that are connected to (or otherwise interoperable with) device 105. Thus, in some cases, one or more of the microphones may be movable (e.g., which may impact a size or shape of listening region 115 as described below).

In aspects of the present disclosure, device 105 may generate an output signal that estimates a target auditory signal from a target audio source 110. In some examples, the target audio source 110 may be located within listening region 115. The size and/or shape of listening region 115 may be based at least in part on the a physical distribution of the microphones. The range of listening region 115 may be based at least in part on the strength of the signal generated by a target audio source 110. In some cases, listening region 115 may represent a constraint on a training operation (e.g., such that device 105 may include a directionality of target audio source 110 as a factor in generating a clean signal estimate). Thus, the dimensions of listening region 115 may generally depend on a microphone arrangement associated with device 105, and these dimensions (which may in some cases be determined based at least in part on training a recurrent neural network) may be used as a constraint for determining a clean signal estimate from a target audio source 110 within listening region 115. For example, the directionality of target audio source 110 may be used to determine time-delay of arrival (TDOA) information, which may in turn support combination of signals from the target audio source 110 that are received at each of the multiple microphones.

In some cases, device 105 may receive auditory signals from audio interference sources 120-*a*, 120-*b* within communication environment 125. In accordance with the present disclosure, device 105 may generate an output signal that estimates a target auditory signal generated at target audio source 110 while minimizing (or eliminating) the auditory signals from audio interference sources 120.

As an illustrative example, device 105 may operate within communication environment 125 (e.g., a bathroom, a restaurant, a gym), wherein communication environment 125 features a plurality of auditory sources (e.g., other speakers, background noise). In some such cases, device 105 may be directed (e.g., manually by a user of the device, automatically by another component of the device) towards target audio source 110 in order to receive a target audio signal (e.g., speech) sent from target audio source 110. In some cases, directing device 105 towards target audio source 110 may refer to adjusting an orientation of device 105 and or adjusting an orientation of one or more microphones associated with device 105. That is, target audio source 110 may be located within listening region 115, which may be based on the arrangement of the microphones of device 105. In some examples, audio interference sources 120-*a* and 120-*b* may be located within communication environment 125, and auditory signals sent by audio interference sources 120 may be received by device 105. In accordance with aspects of the present disclosure, the effect of auditory signals sent from audio interference sources 120 on a target audio signal from target audio source 110 may be reduced (e.g., ignored, filtered out, minimized) by device 105. For example, the reduction may be based at least in part on a directionality associated with target audio source 110, a type of the target audio signal (e.g., speech, music, etc.), or a combination thereof.

Figure 2:
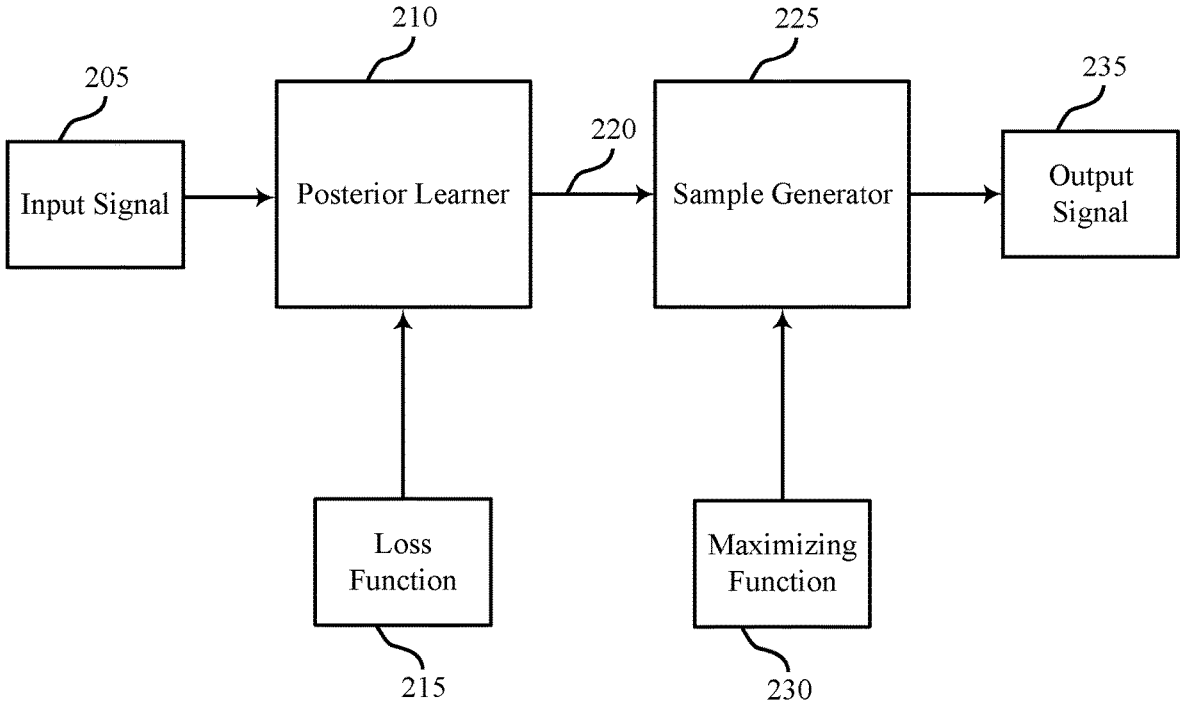
FIG. 2 illustrates an example of a process flow that supports multiple microphone speech generative networks in accordance with aspects of the present disclosure.

FIG. 2 illustrates an example of a process flow 200 that supports multiple microphone speech generative networks in accordance with aspects of the present disclosure. For example, the operations of process flow 200 may be performed by a device such as device 105 as described with reference to FIG. 1. Aspects of process flow 200 may relate to training of (e.g., or operation of) a recurrent neural network (e.g., a long short-term memory (LSTM) network).

A recurrent neural network may refer to a class of artificial neural networks where connections between units (or cells) form a directed graph along a sequence. This property may allow the recurrent neural network to exhibit dynamic temporal behavior (e.g., by using internal states or memory to process sequences of inputs). Such dynamic temporal behavior may distinguish recurrent neural networks from other artificial neural networks (e.g., feedforward neural networks). A LSTM network, in turn, may refer to a recurrent neural network composed of multiple storage states (e.g., which may be referred to as gated states, gated memories, or the like), which storage states may in some cases be controllable by the LSTM network. Specifically, each storage state may include a cell, an input gate, an output gate, and a forget gate. The cell may be responsible for remembering values over arbitrary time intervals. Each of the input gate, output gate, and forget gate may be an example of an artificial neuron (e.g., as in a feedforward neural network). That is, each gate may compute an activation (e.g., using an activation function) of a weighted sum, which weighted sum may be based on training of the neural network. Although described in the context of LSTM networks, it is to be understood that the described techniques may be relevant for any of a number of artificial neural networks (e.g., including hidden Markov models, feedforward neural networks, etc.).

At 205, a device may receive an input signal at each of a plurality of microphones, where each input signal comprises a target audio component as well as various noise artifacts. At 210, the device may train a posterior learner (e.g., based on applying a loss function, which may be identified at 215, to the input signals received at 205). In aspects of the present disclosure, a loss function may generally refer to a function that maps an event (e.g., values of one or more variables) to a value that intuitively represents a cost associated with the event. In some examples, the posterior learner may train a LSTM network (e.g., by adjusting the weighted sums used for the various gates, by adjusting the connectivity between different cells, or the like) so as to minimize the loss function.

For example, the posterior learner may train the LSTM network (based on the loss function) to generate a distribution function 220 that approximates an actual (e.g., but unknown) distribution of the input signals received at 205. By way of example, when training the LSTM network to recognize speech signals within a given listening region, the distribution function 220 may resemble a Laplacian distribution. At 225, a sample generator may generate an estimate of the target auditory component. For example, the estimate may be based at least in part on application of a maximizing function at 230 to distribution function 220. For example, the maximizing function may identify an argument corresponding to a maximum of distribution function 220, where the estimate of the target auditory component is based at least in part on the argument identified at 230. At 235, the sample generator may generate and output an estimate of the target auditory component based on the result of the maximizing function applied at 230.

In some examples, input signals received at 205 may be auditory signals received by the microphones of a device. Each input signal received at 205 may be sampled based on a target time window, such that the input signal for microphone N of the device may be represented as $x_t^N = f(y_t, \alpha, mic^N) + n_t^N$ where $y_t$ represents the target auditory component, $\alpha$ represents a directionality constant associated with the source of the target auditory component, $mic^N$ represents the microphone of the plurality of microphones that receives the target auditory component, and $n_t^N$ represents noise artifacts received at microphone N. In some cases, the target time window may span from a beginning time $T_b$ to a final time $T_f$. Accordingly, the samples of input signals received at 205 may correspond to times $t-T_b$ to $t+T_f$. Though described in the context of a time window, it is to be understood that the samples of the input signals received at 205 may additionally or alternatively correspond to samples in the frequency domain (e.g., samples containing spectral information).

In some cases, the operations of the posterior learner at 210 may be based at least in part on a set of samples that correspond to a time $t+T_f-1$ (e.g., a set of previous samples). The samples corresponding to time $t+T_f-1$ may be referred to as hidden states in a recurrent neural network and may be denoted according to $h_{t+T_f-1}^{M}$, where M corresponds to a given hidden state of the neural network. That is, the recurrent neural network may contain multiple hidden states (e.g., may be an example of a deep-stacked neural network), and each hidden state may be controlled by one or more gating functions as described above.

In some examples, the loss function identified at 215 may be defined according to $p(z|x_{t+T_f}^1, \ldots, x_{t+T_f}^N, h_{t+T_f-1}^1, \ldots, h_{t+T_f-1}^M)$, where z represents a probability distribution given the input signals received at 205 and the hidden states of the neural network. That is, the operations of the posterior learner at 210 may generate distribution function 220 by relating the probability that the samples of the input signals received at 205 match a learned distribution function z of a desired auditory signal based on the loss function identified at 215.

In some cases, the sample generator at 225 may apply a maximizing function at 230 to distribution function 220, wherein the maximizing function may be defined according to $\text{argmax}_z p(z|x_{t+T_f}^1, \ldots, x_{t+T_f}^N, h_{t+T_f-1}^1, \ldots, h_{t+T_f-1}^M)$. Accordingly, the sample generator at 225 may determine an argument value that corresponds to a maximum value of distribution function 220. The sample generator at 225 may then generate an estimate of the target audio component based at least in part on the determined argument value.

Figure 3:
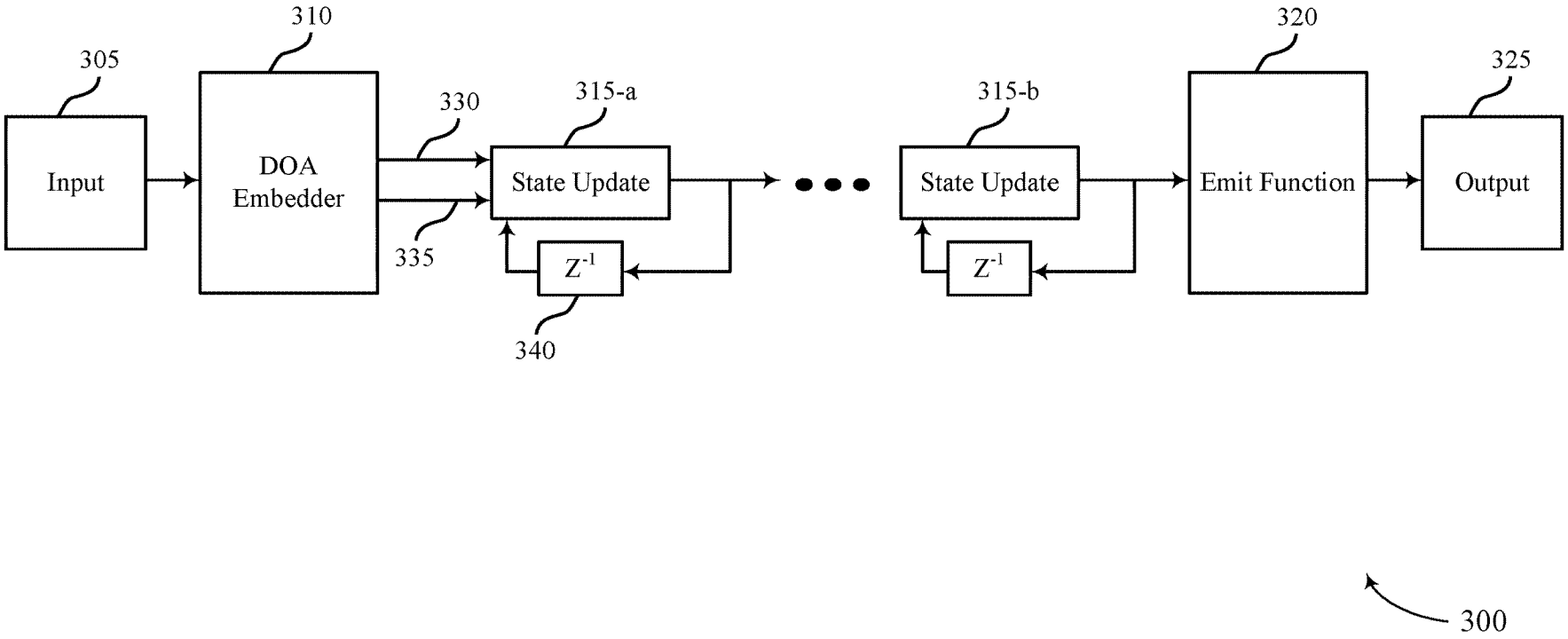
FIG. 3 illustrates an example of a process flow that supports multiple microphone speech generative networks in accordance with aspects of the present disclosure.

FIG. 3 illustrates an example of a process flow 300 that supports multiple microphone speech generative networks in accordance with aspects of the present disclosure. For example, the operations of process flow 300 may be performed by a device such as device 105 as described with reference to FIG. 1. Aspects of process flow 300 may relate to training of (e.g., or operation of) a recurrent neural network (e.g., a LSTM network).

In some cases, a device may receive input audio signals at 305. For example, each input audio signal may be received at a respective microphone at the device and may contain a respective representation of a target audio component (e.g., a time-delayed version of the target audio component based on the location of the microphone relative to other microphones of the device) as well as various noise artifacts. At 310, a direction-of-arrival (DOA) embedder may determine a time-delay for each microphone of the speech generator based at least in part on a directionality associated with a listening region as described with reference to FIG. 1. That is, a target auditory component may be assigned a directionality constraint 330 (e.g., based on the arrangement of the microphones) such that samples of the target auditory component may be a function of the directionality constraint. The samples of the input audio signals received at 305 (e.g., samples 335) may be generated based at least in part on the determined time-delay associated with each microphone of the speech generator.

The samples 335 may then be processed according to state updates 315 based at least in part on the directionality constraint 330. Each state update may reflect the techniques described with reference to FIG. 2. That is, process flow 300 may utilize a plurality of state updates (e.g., state update 315-*a* through state update 315-*b*). Each state update 315 may be an example of a hidden state (e.g., a LSTM cell as described above). That is, each state update 315 may operate on an input (e.g., samples 335, an output from a previous state update 315, etc.) to produce an output. In some cases, the operations of each state update 315 may be based at least in part on a recursion 340 (e.g., which may update a state of a cell based on the output from the cell). In some cases, recursion 340 may be involved in training (e.g., optimizing) a recurrent neural network illustrated by process flow 300.

At 320, an emit function may generate an output signal 325. For example, the output signal 325 may be an estimate of a target auditory component. Though process flow 300 illustrates two state updates 315, it is to be understood that any number of state updates 315 may be included without deviating from the scope of the present disclosure.

Figure 4:
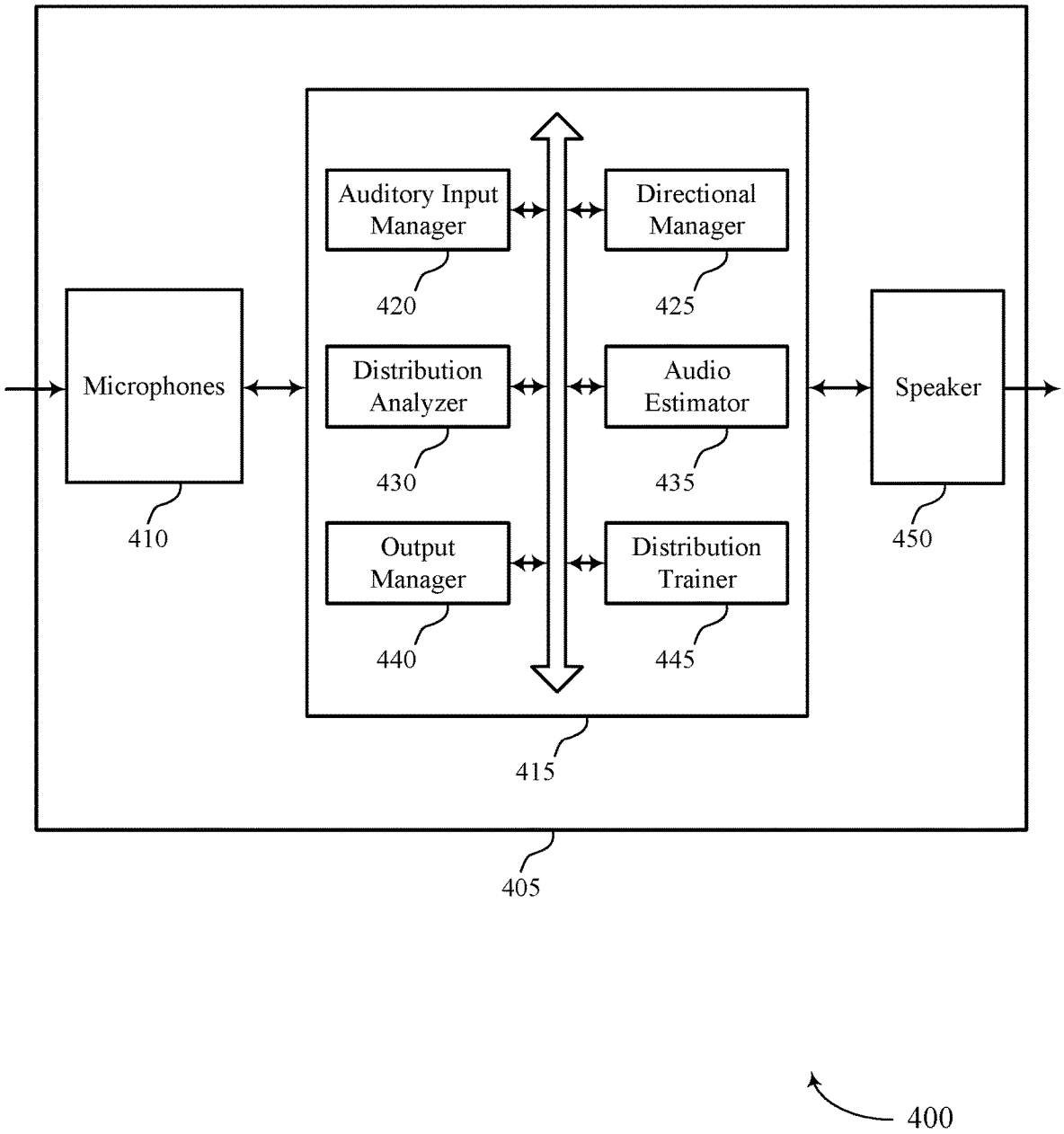
FIG. 4 shows a block diagram of devices that supports multiple microphone speech generative networks in accordance with aspects of the present disclosure.

FIG. 4 shows a block diagram 400 of a device 405 that supports multiple microphone speech generative networks in accordance with aspects of the present disclosure. The device 405 may include microphones 410, an audio processor 415, and a speaker 450. The device 405 may also include a processor. Each of these components may be in communication with one another (e.g., via one or more buses).

Microphones 410 may be or represent components of device 405 used to receive information (e.g., audio signals, data packets, etc.). Generally, microphones 410 may represent transducers for converting sound (e.g., or another physical signal) into an electrical signal (e.g., for processing by audio processor 415). In accordance with the described techniques, device 405 may include multiple microphones 410 arranged according to a given pattern (e.g., which pattern may inform or influence a directional signal processing capability of device 405 as described with reference to directional manager 425). Information may be passed from microphones 410 to other components of the device 405.

The audio processor 415 may be an example of aspects of the audio processor 510 described with reference to FIG. 5. The audio processor 415, or its sub-components, may be implemented in hardware, code (e.g., software or firmware) executed by a processor, or any combination thereof. If implemented in code executed by a processor, the functions of the audio processor 415, or its sub-components may be executed by a general-purpose processor, a DSP, an application-specific integrated circuit (ASIC), a FPGA or other programmable logic device, discrete gate or transistor logic, discrete hardware components, or any combination thereof designed to perform the functions described in the present disclosure.

The audio processor 415, or its sub-components, may be physically located at various positions, including being distributed such that portions of functions are implemented at different physical locations by one or more physical components. In some examples, the audio processor 415, or its sub-components, may be a separate and distinct component in accordance with various aspects of the present disclosure. In some examples, the audio processor 415, or its sub-components, may be combined with one or more other hardware components, including but not limited to an input/output (I/O) component, a transceiver, a network server, another computing device, one or more other components described in the present disclosure, or a combination thereof in accordance with various aspects of the present disclosure.

The audio processor 415 may include an auditory input manager 420, a directional manager 425, a distribution analyzer 430, an audio estimator 435, an output manager 440, and a distribution trainer 445. Each of these modules may communicate, directly or indirectly, with one another (e.g., via one or more buses).

The auditory input manager 420 may receive a respective auditory signal via each of a set of microphones 410, where each auditory signal includes a respective representation of a target auditory component and one or more noise artifacts.

The directional manager 425 may identify a directionality associated with a source of the target auditory component. In some cases, the directionality associated with the source of the target auditory component is based on a spatial arrangement of the set of microphones 410.

The distribution analyzer 430 may determine a distribution function for the target auditory component based on the directionality associated with the source and on the received set of auditory signals. In some examples, the distribution analyzer 430 may identify, for each of the received set of auditory signals, a respective set of samples corresponding to a target time window. In some examples, the distribution analyzer 430 may generate the distribution function for the target time window based on the set of samples for each of the set of auditory signals.

In some examples, the distribution analyzer 430 may determine, based on the directionality associated with the source of the target auditory component, a time-delay for a given microphone 410. In some examples, the distribution analyzer 430 may generate the given set of samples by applying the time-delay to the respective auditory signal received at the given microphone 410. In some examples, the distribution analyzer 430 may identify a vector corresponding to a hidden state of a recurrent neural network, the hidden state associated with a second time window different from the target time window. In some examples, the distribution analyzer 430 may generate the distribution function based on the vector. In some cases, the hidden state of the recurrent neural network includes a cell of a LSTM network.

The audio estimator 435 may generate an estimate of the target auditory component based on the distribution function. In some examples, the audio estimator 435 may identify an argument value corresponding to a maximum value of the distribution function, where the estimate of the target auditory component is based on the argument value. In some cases, the target auditory component includes a speech signal. In some cases, the estimate of the target auditory component includes a vector in a complex spectrum domain.

The output manager 440 may output the estimate of the target auditory component (e.g., to speaker 450).

The distribution trainer 445 may identify a target distribution function based at least part on a type of the target auditory component. In some examples, the distribution trainer 445 may generate a distribution adjustment factor by applying a loss function to the estimate of the target auditory component and the target distribution function. In some examples, the distribution trainer 445 may determine a second distribution function for a second target auditory component received in a second auditory signal based on the distribution adjustment factor.

The speaker 450 may represent a transducer for converting an electrical signal to a sound. Thus, speaker 450 may in some cases output a clean sound estimate representing the processed target auditory component received at the set of microphones 410. In some cases, speaker 450 may be replaced (e.g., or supplemented) by a transmitter, a memory of the device, or the like. For example, rather than (or in addition to) outputting a clean signal via speaker 450, device 405 may transmit the clean signal to another device and/or may store the clean signal in a system memory.

Figure 5:
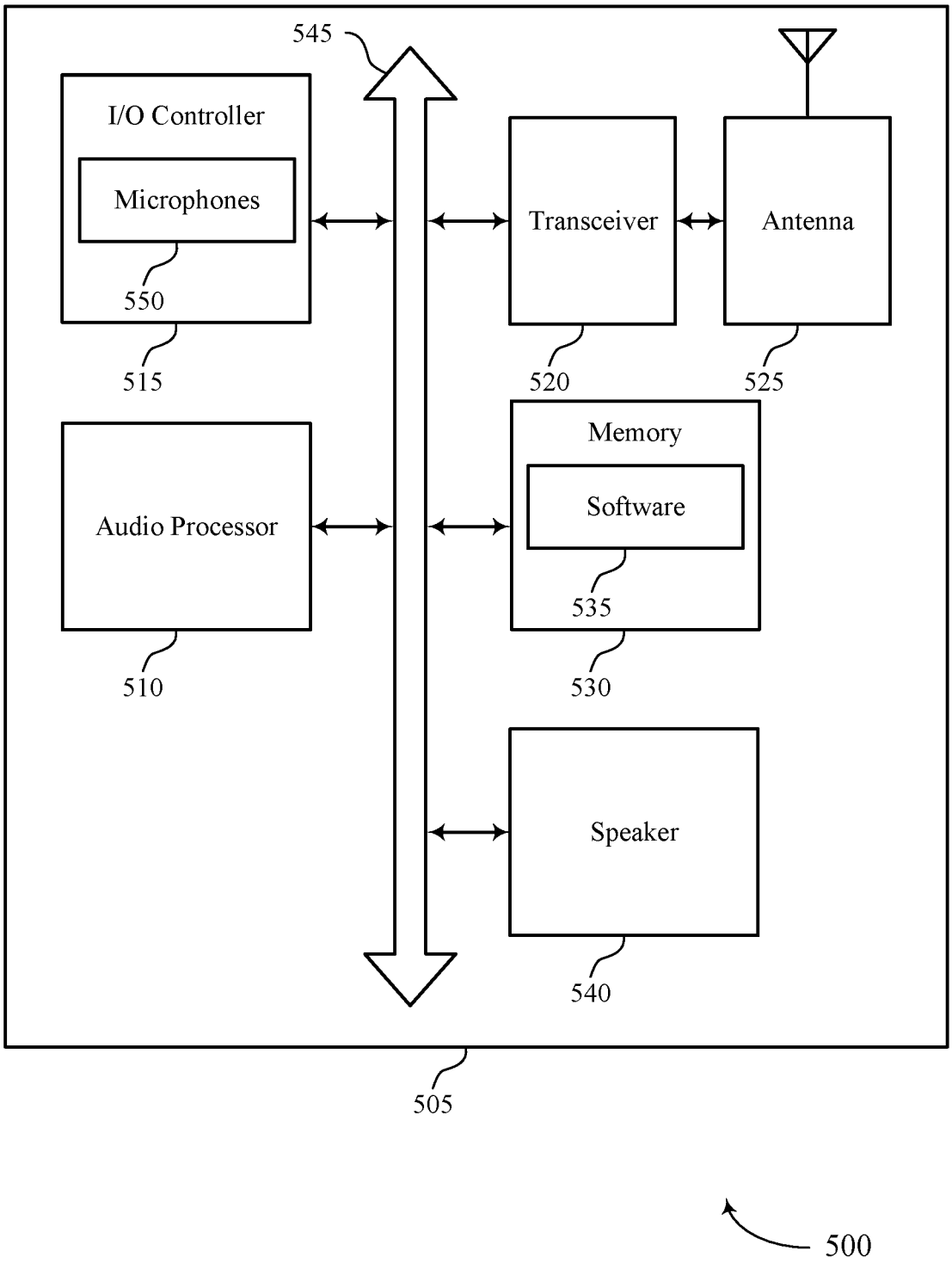
FIG. 5 shows a diagram of a system including a device that supports multiple microphone speech generative networks in accordance with aspects of the present disclosure.

FIG. 5 shows a diagram of a system 500 including a device 505 that supports multiple microphone speech generative networks in accordance with aspects of the present disclosure. The device 505 may include components for bi-directional voice and data communications including components for transmitting and receiving communications, including an audio processor 510, an I/O controller 515, a transceiver 520, an antenna 525, memory 530, and a speaker 540. These components may be in electronic communication via one or more buses (e.g., bus 545).

The audio processor 510 may include an intelligent hardware device, (e.g., a general-purpose processor, a digital signal processor (DSP), an image signal processor (ISP), a central processing unit (CPU), a graphics processing unit (GPU), a microcontroller, an application-specific integrated circuit (ASIC), a field-programmable gate array (FPGA), a programmable logic device, a discrete gate or transistor logic component, a discrete hardware component, or any combination thereof). In some cases, audio processor 510 may be configured to operate a memory array using a memory controller. In other cases, a memory controller may be integrated into audio processor 510. Audio processor 510 may be configured to execute computer-readable instructions stored in a memory to perform various functions (e.g., functions or tasks supporting multiple microphone speech generative networks).

The I/O controller 515 may manage input and output signals for the device 505. The I/O controller 515 may also manage peripherals not integrated into the device 505. In some cases, the I/O controller 515 may represent a physical connection or port to an external peripheral. In some cases, the I/O controller 515 may utilize an operating system such as iOS®, ANDROID®, MS-DOS®, MS-WINDOWS®, OS/2®, UNIX®, LINUX®, or another known operating system. In other cases, the I/O controller 515 may represent or interact with a modem, a keyboard, a mouse, a touchscreen, or a similar device. In some cases, the I/O controller 515 may be implemented as part of a processor. In some cases, a user may interact with the device 505 via the I/O controller 515 or via hardware components controlled by the I/O controller 515. In some cases, I/O controller 515 may be or include a set of microphones 550.

The transceiver 520 may communicate bi-directionally, via one or more antennas, wired, or wireless links as described above. For example, the transceiver 520 may represent a wireless transceiver and may communicate bi-directionally with another wireless transceiver. The transceiver 520 may also include a modem to modulate the packets and provide the modulated packets to the antennas for transmission, and to demodulate packets received from the antennas. In some cases, the wireless device may include a single antenna 525. However, in some cases the device may have more than one antenna 525, which may be capable of concurrently transmitting or receiving multiple wireless transmissions.

Device 505 may participate in a wireless communications system (e.g., may be an example of a mobile device). A mobile device may also be referred to as a user equipment (UE), a wireless device, a remote device, a handheld device, or a subscriber device, or some other suitable terminology, where the "device" may also be referred to as a unit, a station, a terminal, or a client. A mobile device may be a personal electronic device such as a cellular phone, a PDA, a tablet computer, a laptop computer, or a personal computer. In some examples, a mobile device may also refer to as an internet of things (IoT) device, an internet of everything (IoE) device, a machine-type communication (MTC) device, or the like, which may be implemented in various articles such as appliances, vehicles, meters, or the like.

Memory 530 may comprise one or more computer-readable storage media. Examples of memory 530 include, but are not limited to, random access memory (RAM), static RAM (SRAM), dynamic RAM (DRAM), read-only memory (ROM), electrically erasable programmable read-only memory (EEPROM), compact disc read-only memory (CD-ROM) or other optical disc storage, magnetic disc storage, or other magnetic storage devices, flash memory, or any other medium that can be used to store desired program code in the form of instructions or data structures and that can be accessed by a computer or a processor.

Memory 530 may store program modules and/or instructions that are accessible for execution by audio processor 510. That is, memory 530 may store computer-readable, computer-executable software 535 including instructions that, when executed, cause the processor to perform various functions described herein. In some cases, the memory 530 may contain, among other things, a basic input/output system (BIOS) which may control basic hardware or software operation such as the interaction with peripheral components or devices. The software 535 may include code to implement aspects of the present disclosure, including code to support multi-context real time inline image signal processing. Software 535 may be stored in a non-transitory computer-readable medium such as system memory or other memory. In some cases, the software 535 may not be directly executable by the processor but may cause a computer (e.g., when compiled and executed) to perform functions described herein.

Speaker 540 may be an example of speaker 450 as described with reference to FIG. 4. Thus, speaker 540 may represent a transducer for converting an electrical signal to a sound. In some cases, speaker 540 may be replaced (e.g., or supplemented) by a transceiver 520, a memory 530, or the like. For example, rather than (or in addition to) outputting a clean signal via speaker 540, device 505 may transmit the clean signal to another device via transceiver 520 and/or may store the clean signal in memory 530.

Figure 6:
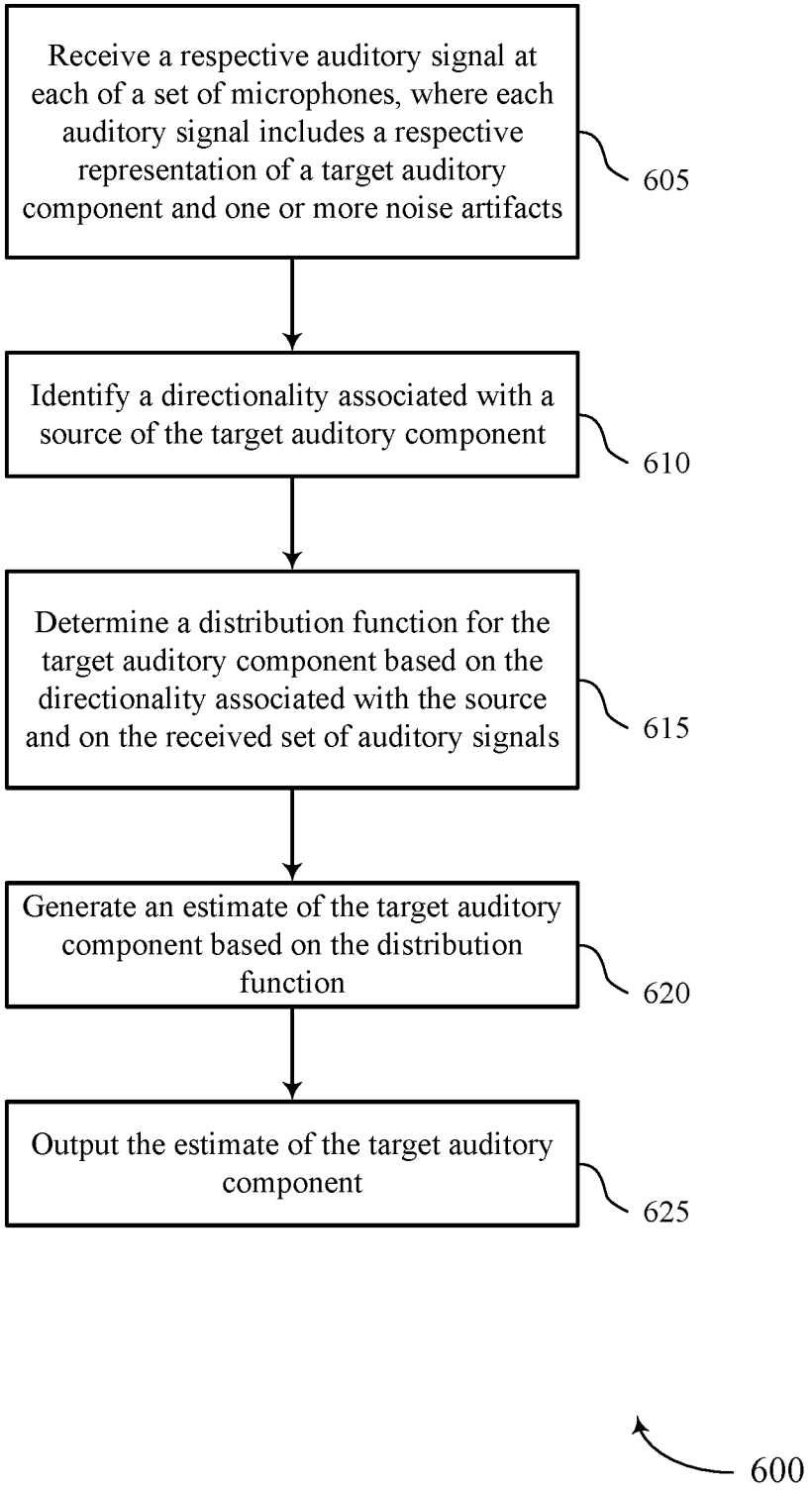
FIGS. 6 through 10 show flowcharts illustrating methods that support multiple microphone speech generative networks in accordance with aspects of the present disclosure.

FIG. 6 shows a flowchart illustrating a method 600 that supports multiple microphone speech generative networks in accordance with aspects of the present disclosure. The operations of method 600 may be implemented by a device or its components as described herein. For example, the operations of method 600 may be performed by an audio processor as described with reference to FIGS. 4 and 5. In some examples, a device may execute a set of instructions to control the functional elements of the device to perform the functions described below. Additionally or alternatively, a device may perform aspects of the functions described below using special-purpose hardware.

At 605, the device may receive a respective auditory signal at each of a set of microphones, where each auditory signal includes a respective representation of a target auditory component and one or more noise artifacts. The operations of 605 may be performed according to the methods described herein. In some examples, aspects of the operations of 605 may be performed by an auditory input manager as described with reference to FIG. 4.

At 610, the device may identify a directionality associated with a source of the target auditory component. The operations of 610 may be performed according to the methods described herein. In some examples, aspects of the operations of 610 may be performed by a directional manager as described with reference to FIG. 4.

At 615, the device may determine a distribution function for the target auditory component based on the directionality associated with the source and on the received set of auditory signals. The operations of 615 may be performed according to the methods described herein. In some examples, aspects of the operations of 615 may be performed by a distribution analyzer as described with reference to FIG. 4.

At 620, the device may generate an estimate of the target auditory component based on the distribution function. The operations of 620 may be performed according to the methods described herein. In some examples, aspects of the operations of 620 may be performed by an audio estimator as described with reference to FIG. 4.

At 625, the device may output the estimate of the target auditory component. The operations of 625 may be performed according to the methods described herein. In some examples, aspects of the operations of 625 may be performed by an output manager as described with reference to FIG. 4.

Figure 7:
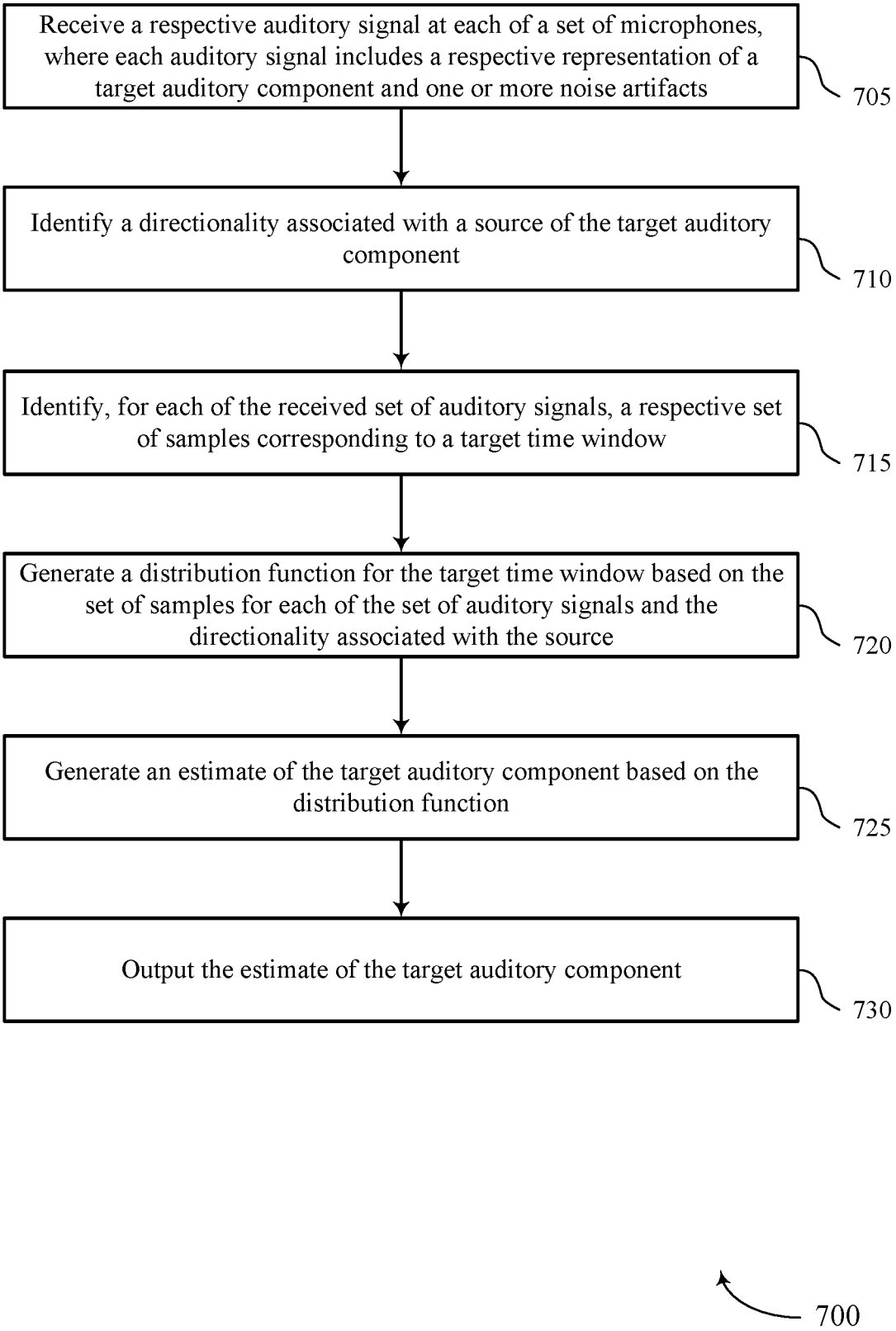

FIG. 7 shows a flowchart illustrating a method 700 that supports multiple microphone speech generative networks in accordance with aspects of the present disclosure. The operations of method 700 may be implemented by a device or its components as described herein. For example, the operations of method 700 may be performed by an audio processor as described with reference to FIGS. 4 and 5. In some examples, a device may execute a set of instructions to control the functional elements of the device to perform the functions described below. Additionally or alternatively, a device may perform aspects of the functions described below using special-purpose hardware.

At 705, the device may receive a respective auditory signal at each of a set of microphones, where each auditory signal includes a respective representation of a target auditory component and one or more noise artifacts. The operations of 705 may be performed according to the methods described herein. In some examples, aspects of the operations of 705 may be performed by an auditory input manager as described with reference to FIG. 4.

At 710, the device may identify a directionality associated with a source of the target auditory component. The operations of 710 may be performed according to the methods described herein. In some examples, aspects of the operations of 710 may be performed by a directional manager as described with reference to FIG. 4.

At 715, the device may identify, for each of the received set of auditory signals, a respective set of samples corresponding to a target time window. The operations of 715 may be performed according to the methods described herein. In some examples, aspects of the operations of 715 may be performed by a distribution analyzer as described with reference to FIG. 4.

At 720, the device may generate a distribution function for the target time window based on the set of samples for each of the set of auditory signals and the directionality associated with the source. The operations of 720 may be performed according to the methods described herein. In some examples, aspects of the operations of 720 may be performed by a distribution analyzer as described with reference to FIG. 4.

At 725, the device may generate an estimate of the target auditory component based on the distribution function. The operations of 725 may be performed according to the methods described herein. In some examples, aspects of the operations of 725 may be performed by an audio estimator as described with reference to FIG. 4.

At 730, the device may output the estimate of the target auditory component. The operations of 730 may be performed according to the methods described herein. In some examples, aspects of the operations of 730 may be performed by an output manager as described with reference to FIG. 4.

Figure 8:
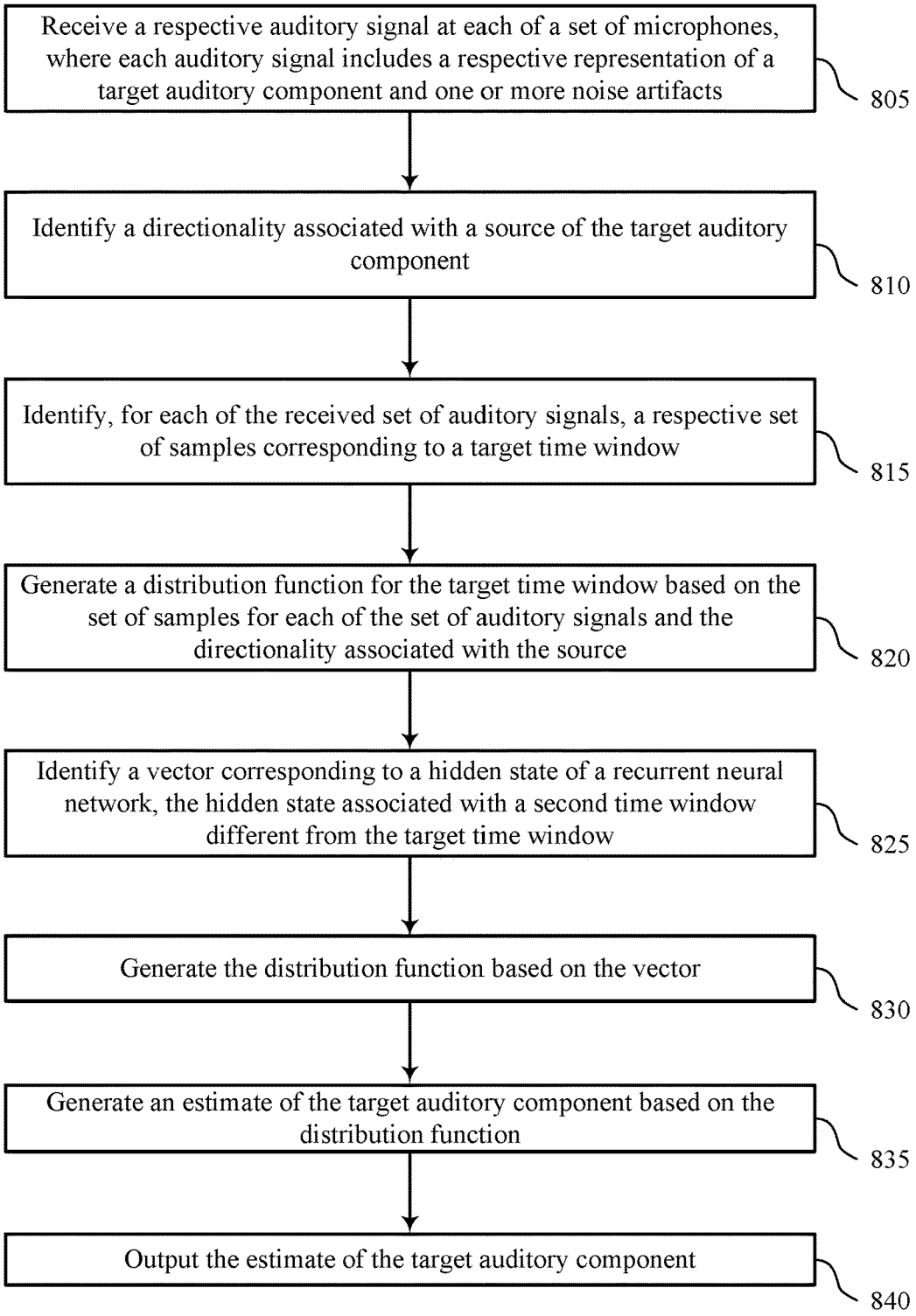

FIG. 8 shows a flowchart illustrating a method 800 that supports multiple microphone speech generative networks in accordance with aspects of the present disclosure. The operations of method 800 may be implemented by a device or its components as described herein. For example, the operations of method 800 may be performed by an audio processor as described with reference to FIGS. 4 and 5. In some examples, a device may execute a set of instructions to control the functional elements of the device to perform the functions described below. Additionally or alternatively, a device may perform aspects of the functions described below using special-purpose hardware.

At 805, the device may receive a respective auditory signal at each of a set of microphones, where each auditory signal includes a respective representation of a target auditory component and one or more noise artifacts. The operations of 805 may be performed according to the methods described herein. In some examples, aspects of the operations of 805 may be performed by an auditory input manager as described with reference to FIG. 4.

At 810, the device may identify a directionality associated with a source of the target auditory component. The operations of 810 may be performed according to the methods described herein. In some examples, aspects of the operations of 810 may be performed by a directional manager as described with reference to FIG. 4.

At 815, the device may identify, for each of the received set of auditory signals, a respective set of samples corresponding to a target time window. The operations of 815 may be performed according to the methods described herein. In some examples, aspects of the operations of 815 may be performed by a distribution analyzer as described with reference to FIG. 4.

At 820, the device may generate a distribution function for the target time window based on the set of samples for each of the set of auditory signals and the directionality associated with the source. The operations of 820 may be performed according to the methods described herein. In some examples, aspects of the operations of 820 may be performed by a distribution analyzer as described with reference to FIG. 4.

At 825, the device may identify a vector corresponding to a hidden state of a recurrent neural network, the hidden state associated with a second time window different from the target time window. The operations of 825 may be performed according to the methods described herein. In some examples, aspects of the operations of 825 may be performed by a distribution analyzer as described with reference to FIG. 4.

At 830, the device may generate the distribution function based on the vector. The operations of 830 may be performed according to the methods described herein. In some examples, aspects of the operations of 830 may be performed by a distribution analyzer as described with reference to FIG. 4.

At 835, the device may generate an estimate of the target auditory component based on the distribution function. The operations of 835 may be performed according to the methods described herein. In some examples, aspects of the operations of 835 may be performed by an audio estimator as described with reference to FIG. 4.

At 840, the device may output the estimate of the target auditory component. The operations of 840 may be performed according to the methods described herein. In some examples, aspects of the operations of 840 may be performed by an output manager as described with reference to FIG. 4.

Figure 9:
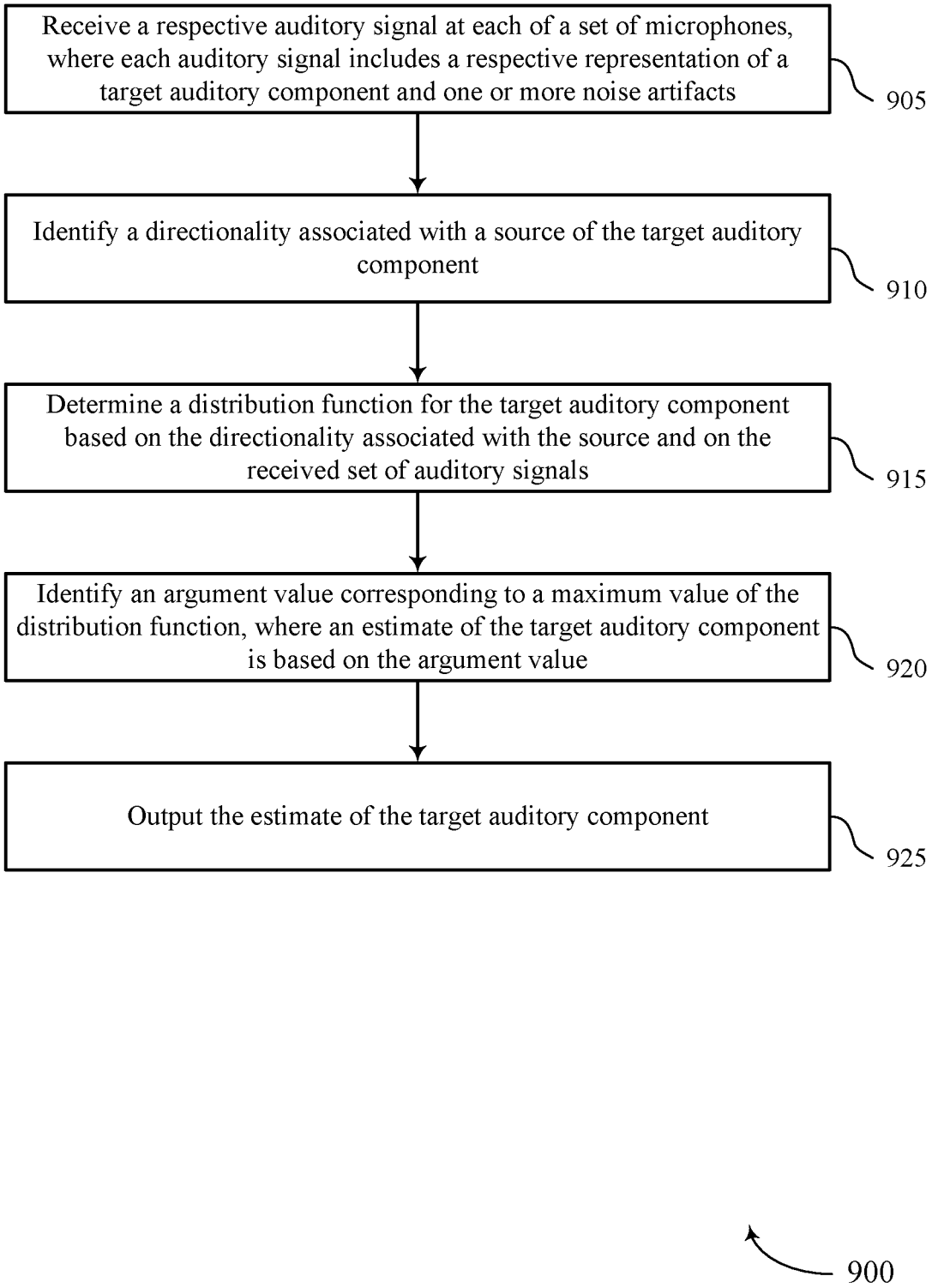

FIG. 9 shows a flowchart illustrating a method 900 that supports multiple microphone speech generative networks in accordance with aspects of the present disclosure. The operations of method 900 may be implemented by a device or its components as described herein. For example, the operations of method 900 may be performed by an audio processor as described with reference to FIGS. 4 and 5. In some examples, a device may execute a set of instructions to control the functional elements of the device to perform the functions described below. Additionally or alternatively, a device may perform aspects of the functions described below using special-purpose hardware.

At 905, the device may receive a respective auditory signal at each of a set of microphones, where each auditory signal includes a respective representation of a target auditory component and one or more noise artifacts. The operations of 905 may be performed according to the methods described herein. In some examples, aspects of the operations of 905 may be performed by an auditory input manager as described with reference to FIG. 4.

At 910, the device may identify a directionality associated with a source of the target auditory component. The operations of 910 may be performed according to the methods described herein. In some examples, aspects of the operations of 910 may be performed by a directional manager as described with reference to FIG. 4.

At 915, the device may determine a distribution function for the target auditory component based on the directionality associated with the source and on the received set of auditory signals. The operations of 915 may be performed according to the methods described herein. In some examples, aspects of the operations of 915 may be performed by a distribution analyzer as described with reference to FIG. 4.

At 920, the device may identify an argument value corresponding to a maximum value of the distribution function, where an estimate of the target auditory component is based on the argument value. The operations of 920 may be performed according to the methods described herein. In some examples, aspects of the operations of 920 may be performed by an audio estimator as described with reference to FIG. 4.

At 925, the device may output the estimate of the target auditory component. The operations of 925 may be performed according to the methods described herein. In some examples, aspects of the operations of 925 may be performed by an output manager as described with reference to FIG. 4.

Figure 10:
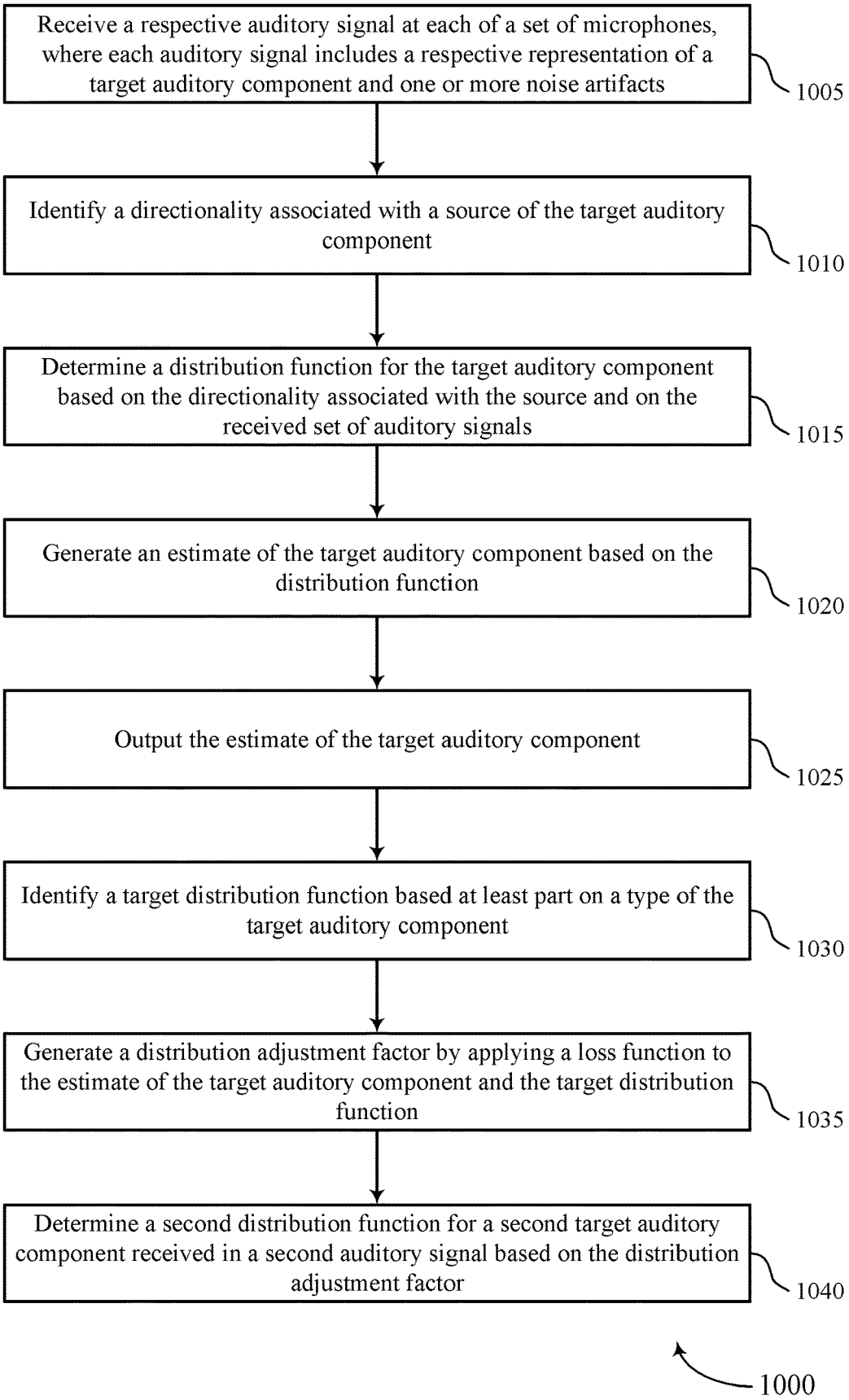

FIG. 10 shows a flowchart illustrating a method 1000 that supports multiple microphone speech generative networks in accordance with aspects of the present disclosure. The operations of method 1000 may be implemented by a device or its components as described herein. For example, the operations of method 1000 may be performed by an audio processor as described with reference to FIGS. 4 and 5. In some examples, a device may execute a set of instructions to control the functional elements of the device to perform the functions described below. Additionally or alternatively, a device may perform aspects of the functions described below using special-purpose hardware.

At 1005, the device may receive a respective auditory signal at each of a set of microphones, where each auditory signal includes a respective representation of a target auditory component and one or more noise artifacts. The operations of 1005 may be performed according to the methods described herein. In some examples, aspects of the operations of 1005 may be performed by an auditory input manager as described with reference to FIG. 4.

At 1010, the device may identify a directionality associated with a source of the target auditory component. The operations of 1010 may be performed according to the methods described herein. In some examples, aspects of the operations of 1010 may be performed by a directional manager as described with reference to FIG. 4.

At 1015, the device may determine a distribution function for the target auditory component based on the directionality associated with the source and on the received set of auditory signals. The operations of 1015 may be performed according to the methods described herein. In some examples, aspects of the operations of 1015 may be performed by a distribution analyzer as described with reference to FIG. 4.

At 1020, the device may generate an estimate of the target auditory component based on the distribution function. The operations of 1020 may be performed according to the methods described herein. In some examples, aspects of the operations of 1020 may be performed by an audio estimator as described with reference to FIG. 4.

At 1025, the device may output the estimate of the target auditory component. The operations of 1025 may be performed according to the methods described herein. In some examples, aspects of the operations of 1025 may be performed by an output manager as described with reference to FIG. 4.

At 1030, the device may identify a target distribution function based at least part on a type of the target auditory component. The operations of 1030 may be performed according to the methods described herein. In some examples, aspects of the operations of 1030 may be performed by a distribution trainer as described with reference to FIG. 4.

At 1035, the device may generate a distribution adjustment factor by applying a loss function to the estimate of the target auditory component and the target distribution function. The operations of 1035 may be performed according to the methods described herein. In some examples, aspects of the operations of 1035 may be performed by a distribution trainer as described with reference to FIG. 4.

At 1040, the device may determine a second distribution function for a second target auditory component received in a second auditory signal based on the distribution adjustment factor. The operations of 1040 may be performed according to the methods described herein. In some examples, aspects of the operations of 1040 may be performed by a distribution trainer as described with reference to FIG. 4.

In some cases, the operations described with reference to 1030, 1035, and 1040 may be referred to as training operations (e.g., for a recurrent neural network associated with the audio processing). These operations may generally provide a means for adapting a response of the audio processor described above based on various sets of training data. For example, such adaptability may allow a device to improve performance (e.g., to refine an estimated distribution function) and/or respond to changes in a communication environment (e.g., such as a different source location, a different microphone arrangement, or the like).

It should be noted that the methods described above describe possible implementations, and that the operations and the steps may be rearranged or otherwise modified and that other implementations are possible. Further, aspects from two or more of the methods may be combined. In some cases, one or more operations described above (e.g., with reference to FIGS. 6 through 10) may be omitted or adjusted without deviating from the scope of the present disclosure. Thus the methods described above are included for the sake of illustration and explanation and are not limiting of scope.

The various illustrative blocks and modules described in connection with the disclosure herein may be implemented or performed with a general-purpose processor, a DSP, an ASIC, a FPGA or other programmable logic device (PLD), discrete gate or transistor logic, discrete hardware components, or any combination thereof designed to perform the functions described herein. A general-purpose processor may be a microprocessor, but in the alternative, the processor may be any conventional processor, controller, microcontroller, or state machine. A processor may also be implemented as a combination of computing devices (e.g., a combination of a DSP and a microprocessor, multiple microprocessors, one or more microprocessors in conjunction with a DSP core, or any other such configuration).

The functions described herein may be implemented in hardware, software executed by a processor, firmware, or any combination thereof. If implemented in software executed by a processor, the functions may be stored on or transmitted over as one or more instructions or code on a computer-readable medium. Other examples and implementations are within the scope of the disclosure and appended claims. For example, due to the nature of software, functions described above can be implemented using software executed by a processor, hardware, firmware, hardwiring, or combinations of any of these. Features implementing functions may also be physically located at various positions, including being distributed such that portions of functions are implemented at different physical locations.

Computer-readable media includes both non-transitory computer storage media and communication media including any medium that facilitates transfer of a computer program from one place to another. A non-transitory storage medium may be any available medium that can be accessed by a general purpose or special purpose computer. By way of example, and not limitation, non-transitory computer-readable media may comprise RAM, ROM, EEPROM, flash memory, CD-ROM or other optical disk storage, magnetic disk storage or other magnetic storage devices, or any other non-transitory medium that can be used to carry or store desired program code means in the form of instructions or data structures and that can be accessed by a general-purpose or special-purpose computer, or a general-purpose or special-purpose processor. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, include CD, laser disc, optical disc, digital versatile disc (DVD), floppy disk and Blu-ray disc where disks usually reproduce data magnetically, while discs reproduce data optically with lasers. Combinations of the above are also included within the scope of computer-readable media.

As used herein, including in the claims, "or" as used in a list of items (e.g., a list of items prefaced by a phrase such as "at least one of" or "one or more of") indicates an inclusive list such that, for example, a list of at least one of A, B, or C means A or B or C or AB or AC or BC or ABC (i.e., A and B and C). Also, as used herein, the phrase "based on" shall not be construed as a reference to a closed set of conditions. For example, an exemplary step that is described as "based on condition A" may be based on both a condition A and a condition B without departing from the scope of the present disclosure. In other words, as used herein, the phrase "based on" shall be construed in the same manner as the phrase "based at least in part on."

In the appended figures, similar components or features may have the same reference label. Further, various components of the same type may be distinguished by following the reference label by a dash and a second label that distinguishes among the similar components. If just the first reference label is used in the specification, the description is applicable to any one of the similar components having the same first reference label irrespective of the second reference label, or other subsequent reference label.

The description set forth herein, in connection with the appended drawings, describes example configurations and does not represent all the examples that may be implemented or that are within the scope of the claims. The term "exemplary" used herein means "serving as an example, instance, or illustration," and not "preferred" or "advantageous over other examples." The detailed description includes specific details for the purpose of providing an understanding of the described techniques. These techniques, however, may be practiced without these specific details. In some instances, well-known structures and devices are shown in block diagram form in order to avoid obscuring the concepts of the described examples.

The description herein is provided to enable a person skilled in the art to make or use the disclosure. Various modifications to the disclosure will be readily apparent to those skilled in the art, and the generic principles defined herein may be applied to other variations without departing from the scope of the disclosure. Thus, the disclosure is not limited to the examples and designs described herein, but is to be accorded the broadest scope consistent with the principles and novel features disclosed herein.

What is claimed is:

1. A device comprising:

a memory configured to store samples of a target audio component; and a processor configured to:

receive an input audio signal including, a time-delayed version of the target audio component and noise artifacts based on a location of a first microphone relative to other microphones of the device;

determine a time-delay for each microphone using a direction of arrival embedder, wherein the direction of arrival embedder generates a set of samples of the target audio component and noise artifacts;

generate modified samples of the target audio component and noise artifacts to reduce contributions of the noise artifacts that are part of the input audio signal with a trained recurrent neural network, coupled to the direction of arrival embedder, wherein the trained neural network is associated with a constraint; and output the modified samples of the target audio component.

2. The device of claim 1, wherein the processor is configured to determine, based on a directionality associated with a source of the target audio component, the constraint, and wherein the constraint is a directionality constraint.

3. The device of claim 2, wherein the generate modified samples with the trained recurrent neural network to the samples are processed according to state updates based at least in part on the directionality constraint.

4. The device of claim 1, wherein the modified samples are stored in a hidden state of the trained recurrent neural network.

5. The device of claim 4, wherein the hidden state of the trained recurrent neural network comprises a cell of a long short-term memory (LSTM) network.

6. The device of claim 5, wherein the hidden state of the recurrent neural network is updated over a first time window, with new samples in a second time window that replace the samples from the first time window.

7. The device of claim 1, wherein the target audio component comprises a speech signal.

8. The device of claim 1, wherein the direction of arrival embedder is configured to associate a directionality a with a source of the target audio component based at least in part on a spatial arrangement of a plurality of microphones.

9. The device of claim 1, wherein the target audio component is located within a listening region, and the listening region represents the constraint.

10. The device of claim 9, wherein the listening region is based at least in part on the strength of the input audio signal.

11. The device of claim 1, further comprising a plurality of microphones configured to capture the input audio signal.

12. A method comprising:

receiving an input audio signal including, a time-delayed version of the target audio component and noise artifacts based on a location of a first microphone relative to other microphones of the device;

determining a time-delay for each microphone using a direction of arrival embedder, wherein the direction of arrival embedder generates a set of samples of the target audio component and noise artifacts;

generating modified samples of the target audio component and noise artifacts to reduce contributions of the noise artifacts that are part of the input audio signal with a trained recurrent neural network, coupled to the direction of arrival embedder, wherein the trained neural network is associated with a constraint; and outputting the modified samples of the target audio component.

13. The method of claim 12, wherein the determining is based on a directionality associated with a source of the target audio component, the constraint, and wherein the constraint is a directionality constraint.

14. The method of claim 13, wherein the generate modified samples with the trained recurrent neural network to the samples are processed according to state updates based at least in part on the directionality constraint.

15. The method of claim 12, wherein the modified samples are stored in a hidden state of the trained recurrent neural network.

16. The method of claim 15, wherein the hidden state of the trained recurrent neural network comprises a cell of a long short-term memory (LSTM) network.

17. The method of claim 16, wherein the hidden state of the recurrent neural network is updated over a first time window, with new samples in a second time window that replace the samples from the first time window.

18. The method of claim 12, wherein the target audio component comprises a speech signal.

19. The method of claim 12, wherein the direction of arrival embedder is configured to associate a directionality a with a source of the target audio component based at least in part on a spatial arrangement of a plurality of microphones.

20. The method of claim 12, wherein the target audio component is located within a listening region, and the listening region represents the constraint.

21. The method of claim 20, wherein the listening region is based at least in part on the strength of the input audio signal.

22. A non-transitory computer-readable storage medium having stored thereon instructions that, when executed, cause one or more processors to:

receive an input audio signal including, a time-delayed version of the target audio component and noise artifacts based on a location of a first microphone relative to other microphones of the device;

determine a time-delay for each microphone using a direction of arrival embedder, wherein the direction of arrival embedder generates a set of samples of the target audio component and noise artifacts;

generate modified samples of the target audio component and noise artifacts to reduce contributions of the noise artifacts that are part of the input audio signal with a trained recurrent neural network, coupled to the direction of arrival embedder, wherein the trained neural network is associated with a constraint; and output the modified samples of the target audio component.

* * * * *